United States Patent [19]

Emerson

[11] Patent Number: 4,572,749

[45] Date of Patent: Feb. 25, 1986

[54] METHOD AND AN APPARATUS FOR HEAT TREATMENT OF A WORKPIECE

[75] Inventor: Richard Emerson, Mebane, N.C.

[73] Assignee: GKN Automotive Components, Inc., Southfield, Mich.

[21] Appl. No.: 587,297

[22] Filed: Mar. 7, 1984

[51] Int. Cl.[4] ..... C21D 9/40; C21D 1/74

[52] U.S. Cl. ..... 148/16.5; 266/125; 266/258; 266/274; 266/287; 148/155; 148/146

[58] Field of Search ..... 266/125, 287, 127, 274, 266/251, 252, 258, 123, 259, 114, 117, 118, 119; 432/250, 251, 252; 148/16.5, 16, 146, 155

[56] References Cited

FOREIGN PATENT DOCUMENTS 27936 8/1971 Japan ..... 266/117

*Primary Examiner*—Christopher W. Brody

*Attorney, Agent, or Firm*—Remy J. VanOphem

[57] ABSTRACT

A method and an apparatus for the heat treatment of a workpiece, particularly an outer race member of a universal joint, having a cavity formed therein. The apparatus includes a horizontally disposed base and at least one elongated vertically disposed post extending upwardly therefrom with a passage extending at least partially longitudinally therethrough. The workpiece is mounted on the elongated vertically disposed post by insertion of the upper end of the elongated vertically disposed post into the cavity, the passage providing a venting of the cavity during the heat treatment operation. The method provides for mounting the outer race member to the upper end of an elongated vertically disposed post by insertion of the upper end of the post into the cavity of the workpiece, heating the workpiece to a predetermined temperature level, communicating the cavity in the workpiece with the environment external to the workpiece by a passage means formed in the elongated vertically disposed post, and quenching the workpiece with a cooling fluid to rapidly cool the outer race member.

19 Claims, 4 Drawing Figures

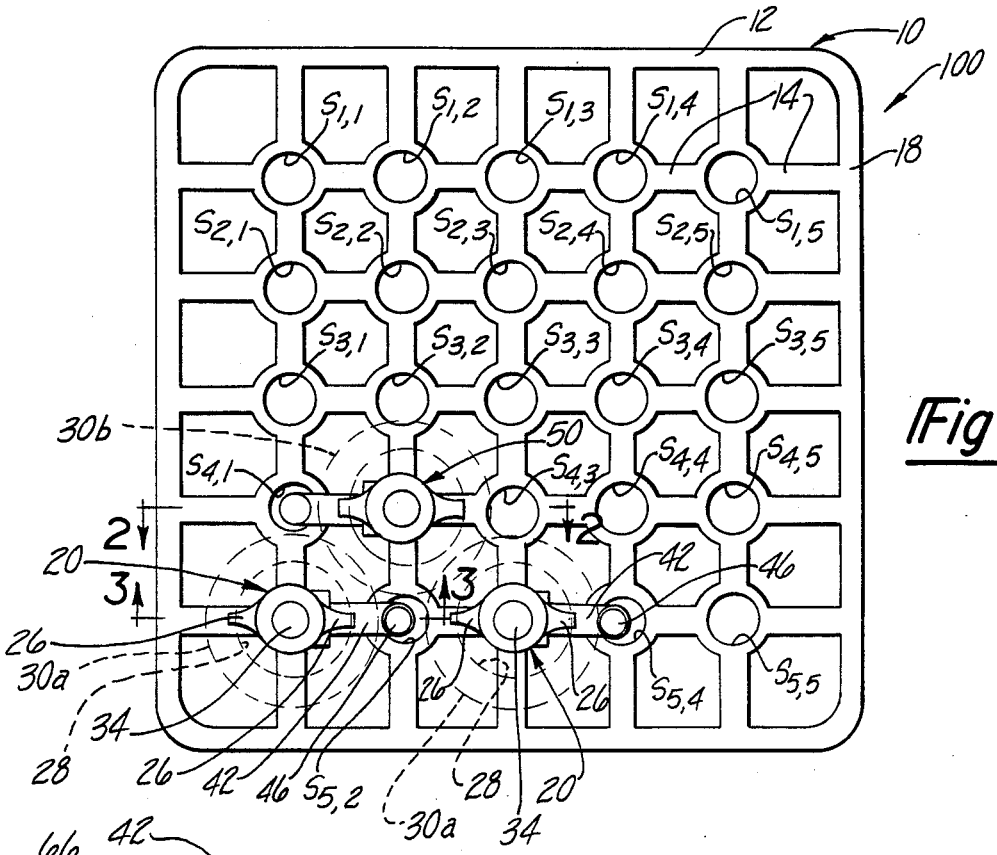
Fig-1
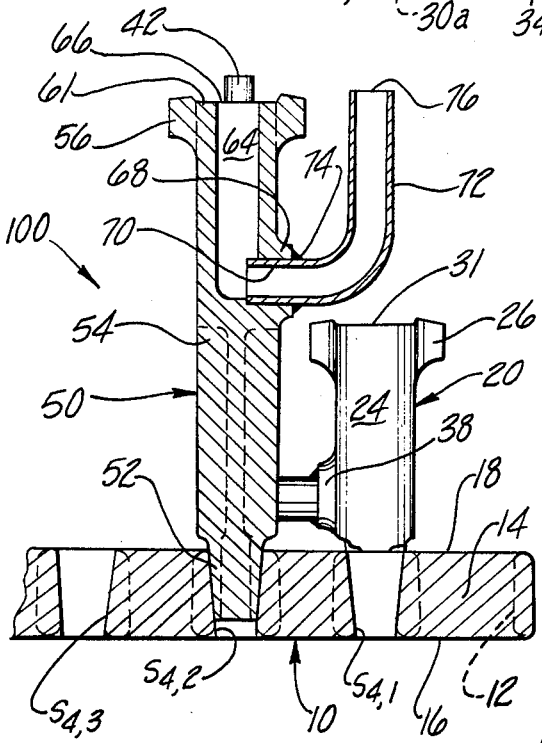
Fig-2
Fig-3
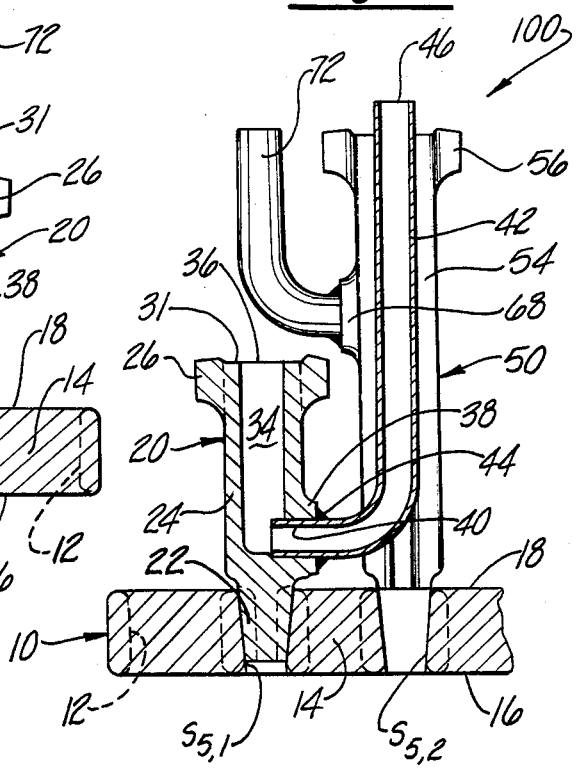

METHOD AND AN APPARATUS FOR HEAT TREATMENT OF A WORKPIECE

BACKGROUND OF THE INVENTION

The present invention is directed to a method and an apparatus for the heat treatment of a workpiece and in particular, for the heat treatment of a workpiece having a cavity formed therein. More particularly, the present invention is directed to a method and an apparatus for supporting an outer race member of a universal joint during a heat treatment operation.

It is often difficult to obtain a quality hardened part when the part has cavities formed in it, due to the nature of the heat treating operation used to harden the parts. Typically, a part is heat treated by heating the part in a carborizing atmosphere to a predetermined temperature and subsequently quenching the part with a cooling fluid. If the part is positioned so that the cavity formed in the part opens upwardly, the cooling fluid used in the quenching operation fills the cavity and the cooling fluid is carried out of the quench tanks after the quenching operation is complete. Therefore, an additional operation is required to remove the cooling fluid from the part and to replace the cooling fluid in the quench tank. A portion of the cooling fluid is wasted during this additional operation.

Alternatively, when the workpiece is heat treated with the cavity disposed such as to open downwardly, the carborizing atmosphere used during the heating step of the heat treatment operation becomes trapped in the upper portion of the cavity during the quench segment of the heat treatment. The carborizing atmosphere, therefore, prevents the cooling fluid from entering the cavity, preventing the workpiece from being uniformly quenched. In particular, the interior surface of the cavity may not be sufficiently hardened by the heat treatment process.

The above described problem exists for all workpieces having cavities, but is particularly serious when the interior surface of the cavity performs a load bearing function, since insufficient hardening of a load bearing surface may result in premature failure of the part.

There are many universal joints in common commercial use which include an outer race member having a cavity formed therein, and an inner race member disposed within the cavity. Various means, well known in the art, are used for interconnecting the inner race member with the outer race member, such as bearing balls, which transfer torque between the inner and outer race members. The inner surface of the cavity experiences substantial loads when torque is transferred between the inner and outer race members and, therefore, must be adequately hardened so as to provide a long life for the outer race member.

To avoid the above described problems during a heat treatment operation, the method and the apparatus of the prior art used for heat treating the outer race members of the universal joints and similar workpieces involved placing the outer race member or workpiece in a horizontal position such that the cavity opened horizontally. This avoids the entrapment of either the carborizing atmosphere or the oil within the cavity. However, in practice, when an outer race member is heat treated in a horizontal position a substantial amount of material movement takes place within the part. This material movement results in an undesirably high rejection rate of outer race meabers which have already been manufactured and heat treated.

What is needed, therefore, is a method and an apparatus for the even and reliable heat treatment of a workpiece having a cavity and, particularly, of the outer race member of a universal joint.

SUMMARY OF THE INVENTION

The present invention provides a method and apparatus for the even and reliable heat treatment of workpieces having cavities and, more particularly, for the heat treatment of the outer race member of a universal joint.

According to the method of the present invention, the workpiece is mounted to the upper end of an elongated vertically disposed post by inserting the upper end of the elongated vertically disposed post into the cavity of the workpiece. The outer race member is heated to a predetermined temperature level in a carborizing atmosphere, the cavity being in communication with the environment external to the outer race member by means of a passage formed in the elongated vertically disposed post. Finally, the outer race member is quenched with a cooling fluid to rapidly cool the outer race member.

The apparatus according to the present invention includes a horizontally disposed base, an elongated vertically disposed post interconnected with the horizontally disposed base and extending upwardly therefrom, and a passage extending longitudinally of the elongated vertically disposed post. A workpiece is mounted to the upper end of the elongated vertically disposed post by the insertion of the upper end of the elongated vertically disposed post into the cavity of the workpiece. The passage in the elongated vertically disposed post provides communication between the cavity of the workpiece and the environment external to the workpiece.

In the preferred embodiment, the apparatus includes one or more plates, each being constructed of a plurality of tubular portions forming sockets therein, and a plurality of web portions interconnecting the tubular portions, such as to form an array of parallel sockets. A plurality of the elongated posts are provided, each having a lower end and an upper end opposite the lower end. A plug is formed at the lower end of each of the plurality of elongated vertically disposed posts for selective insertion into one of the sockets. A passage is provided in each of the plurality of the elongated vertically disposed posts for interconnecting the upper end thereof with an intermediate portion thereof. When more than one plate is used, a plurality of support posts are provided for interconnecting a first plate with a second plate, each of the support posts having a plug disposed at an upper end and a plug disposed at a lower end for selective insertion, respectively, in sockets of the first and second plates.

A principal object of the present invention is to provide a reliable method and apparatus for the heat treatment of a workpiece having a cavity.

Another object of the present invention is to provide a reliable method and apparatus for the even heat treatment of an outer race member of a universal joint.

Yet another object of the present invention is to provide a method and apparatus for the heat treatment of an outer race member of a universal joint such that the cavity of the outer race member is downwardly opened during the heat treatment process.

These, and the many other objects, features, and advantages of the present invention will become apparent to those skilled in the art when the following detailed description of the preferred embodiment is read in conjunction with the drawings appended hereto.

BRIEF DESCRIPTION OF THE DRAWINGS

In the drawings appended hereto, wherein like reference numerals refer to like components throughout:

FIG. 1 is a top view of an apparatus for the heat treatment of an outer race member of a universal joint according to the present invention, with parts removed;

FIGS. 2 and 3 are sectional views taken, respectively, approximately along lines 2—2 and 3—3 of FIG. 1.

DETAILED DESCRIPTION OF THE PREFERRED EMBODIMENT

Figure 4:
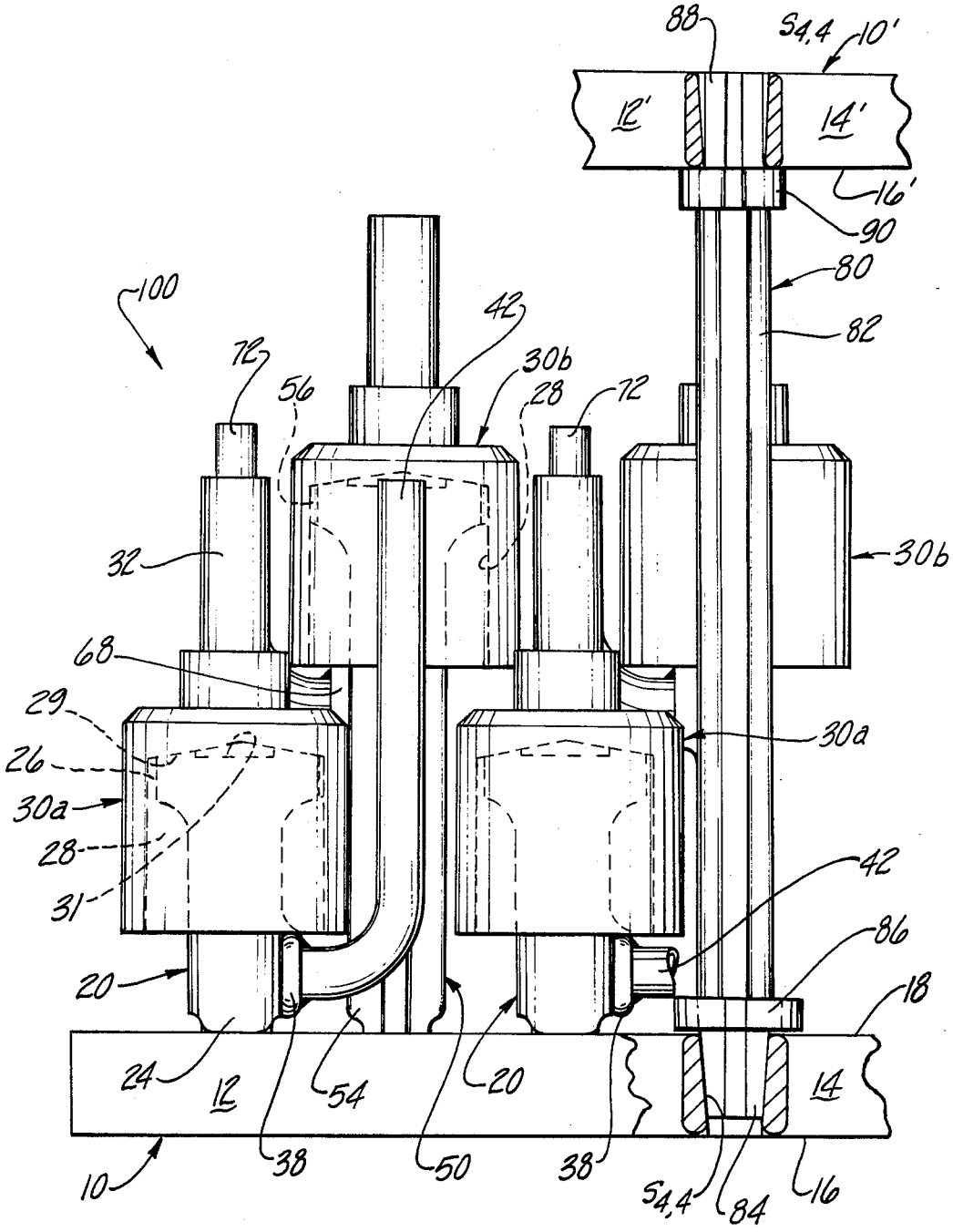
FIG. 4 is a partial front elevational view, with parts cut away, showing the apparatus of FIG. 1, with certain modifications.

Referring now to the drawing, an apparatus 100 according to the present invention for racking an outer race member 30*a* or 30*b* of a universal joint for purposes of heat treating is illustrated in detail.

As shown in FIG. 1, the apparatus 100, according to the present invention, includes a base 10 and a plurality of lower posts 20 and upper posts 50, the lower and upper posts 20 and 50 extending upwardly from the base 10 for the mounting thereto of the outer race member 30*a* or 30*b*.

More particularly, the base 10 is a unitary member formed of a suitable metallic or composite material. The base 10 has a plurality of sockets $S_{1,1}$ through $S_{5,5}$ arranged in a suitable array such as a rectangular array, to define possible interconnection points for the plurality of lower and upper posts 20 and 50, in a manner described herein. The sockets $S_{1,1}$ through $S_{5,5}$ are parallel to each other, as shown in FIGS. 2 and 3. Furthermore, the sockets $S_{1,1}$ through $S_{1,1}$ are preferably tapered for a purpose to be described later. In the preferred embodiment, the sockets $S_{1,1}$ through $S_{5,5}$ of the base 10 are tubular portions which are interconnected by webs 14 with each other and with a perimetric frame 12, the perimetric frame completely surrounding the array of sockets. The base 10 is further provided with a flat bottom surface 16 and a flat top surface 18, as shown in FIGS. 2 and 3.

As indicated above, a plurality of lower posts 20 extend upwardly from the base 10. Each lower post 20 is provided at its lowermost end with a plug 22, as shown in FIG. 3, extending downwardly therefrom for selective insertion in one of the plurality of sockets $S_{1,1}$ through $S_{5,5}$ of the base. The plug 22 is tapered so as to cooperate with the taper of the socket with which it is interconnected to secure the lower post 20 in a fixed position. As illustrated, the plug 22 may be t-shaped in cross-section.

Each lower post 20 further includes an elongated trunk 24 extending upwardly from the plug 22. A plurality of ears or flanges 26 extend radially outwardly and longitudinally upwardly of the uppermost end of the elongated trunk 24.

The outer race member 30*a*, well known in the art, is mounted to the uppermost end of the elongated trunk 24, as shown in FIGS. 1 and 4, by insertion of the upper end of the elongated trunk 24 into a cavity 28 of the outer race member. The outer race member 30*a* is thereby supported by the lower post in a vertical position with a shaft 32 of the outer race member 30*a* shown only in FIG. 4 of the drawing, extending vertically upwardly therefrom. The ears or flanges 26 of the elongated trunk 24 of the lower post 20 cooperate with the outer race member to removably secure the outer race member 30*a* in a fixed position relative to the base 10. The ears 26 further cooperate with the outer race member 30*a* to support the outer race member in a position such that a base 29 of the cavity 28 is disposed a short distance above an uppermost end 31 of the elongated trunk 24 of the lower post 20.

Each of the plurality of lower posts 20 is provided with a passage 34, as depicted in FIGS. 1 and 3, extending partially along the longitudinal axis of the elongated trunk 24 from the uppermost end 31 of the elongated trunk 24 to an intermediate portion thereof. The passage 34 is provided with an opening 36 at the uppermost end 31 of the elongated trunk 24, as depicted in FIG. 3. The opening 36 communicates the passage 34 with the cavity 28 of the outer race member 30*a*.

The elongated trunk 24 of each lower post 20 is further provided with a boss 38 extending radially therefrom at an intermediate location between the ears or flanges 26 and the plug 22. An aperture 40 is formed through the center of the boss 38, as shown in FIG. 3, the aperture 40 opening into the passage 34. One end of a pipe 42 is fitted in the aperture 40 and is interconnected with the boss 38 by means of welds 44. The pipe 42 is bent into an L-shape and extends first radially outwardly from the boss 38, and then upwardly therefrom. The pipe 42 is provided with an opening 46 at its end furthest from the boss 38, the opening communicating the passage 34 with the environment external of the outer race member 30*a*.

As stated above, a plurality of upper posts 50 also extend upwardly from the base 10. As illustrated in FIG. 2, each of the upper posts 50 are provided with a plug 52 for removable interconnection of the upper post with one of the sockets $S_{1,1}$ through $S_{5,5}$ of the base 10 and an elongated trunk 54 extending upwardly therefrom. Each of the upper posts 50 has a plurality of ears or flanges 56 similar to the plurality of ears or flanges 26 of the lower posts 20. An outer race member 30*b* may be mounted to the upper post 50 in a manner similar to that described above for the mounting of an outer race member 30*a* to a lower post 20, as depicted in FIGS. 1 and 4. However, the elongated trunk 54 of the plurality of upper posts 50 is substantially longer than the elongated trunk 24 of the plurality of lower posts 20 so as to support an outer race member 30*b* at a greater height relative to the base 10 than an outer race member 30*a* supported by one of the plurality of lower posts 20 as shown in FIG. 4. The length of the elongated trunks 24 and 54 are preselected such as to permit a dense packing of the outer race members 30*a* and 30*b* in a staggered triangular array. For example, a total of thirteen outer race members 30*a* and 30*b* may be mounted to the base 10 by interconnecting a lower post 20 with each of the nine sockets $S_{1,1}$, $S_{1,3}$, $S_{1,5}$, $S_{3,1}$, $S_{3,3}$, $S_{3,5}$, $S_{5,1}$, $S_{5,3}$, and $S_{5,5}$ and by interconnecting the upper posts 50 to each of the four sockets $S_{2,2}$, $S_{2,4}$, $S_{4,2}$, and $S_{4,4}$.

As best shown in FIG. 2, each of the plurality of upper posts 50 are provided with a longitudinal passage 64 having an opening 66 disposed adjacent the upper end 61 of the elongated trunk 54 thereof. Each of the plurality of upper posts 50 has a boss 68, and an aperture 70 therethrough, the aperture 70 extending into the longitudinal passage 64. A pipe 72 is fitted into each of the apertures 70 of the plurality of upper posts 50 and is welded to the boss 68 thereof by welds 74. Each of the pipes 72 is L-shaped and extends radially outwardly of the upper post 50 and then upwardly therefrom.

An opening 76 is provided at the upper end of the pipe 72, remote from the boss 68. The openings 66 and 76 communicate the cavity 28 of an outer race member **30*b* mounted to the upper end of the upper post 50 with the environment external of the outer race member 30*b***.

As shown in FIG. 4, the apparatus 100 according to the present invention may be extended upwardly for the mounting of additional outer race members **30*a* and 30*b* by the provision of an additional base 10' substantially identical to the base 10 described previously. As indicated in FIG. 4, the additional base 10' has a plurality of sockets, only the socket $S_{4,4}'$ being shown in the drawing, interconnected by a plurality of webs 14' with each other and with a perimetric frame 12'. The additional base 10' is further provided with a flat bottom surface 16'**.

A plurality of support posts 80, only one of which is shown in the drawing, are provided for mounting the additional base 10' to the base 10. Each support post 80 has an elongated trunk 82 provided with a lower plug 84 similar to the plugs 22 and 52, respectively, of the lower posts 20 and the upper posts 50. The lower plug 84 is removably insertable in a socket, for example the socket $S_{4,4}$ of the base 10. The elongated trunk 82 is stabilized in position, relative to the base 10, by means of a radial flange 86 disposed adjacent to the lower plug 84, the radial flange 86 cooperating with the top surface 18 of the base 10.

Each support post 80 is also provided with an upper plug 88 removably insertable in one of the sockets, for example the socket $S_{4,4}'$ of the additional base 10'. Unlike the lower plug 84 and the plugs 22 and 52, the upper plug 88 of the support post 80 is not tapered. A radial flange 90 extends from the elongated trunk 82 to the support post 80 adjacent the upper plug 88. The radial flange 90 cooperates with the bottom surface 16' the additional base 10' to provide a stable interconnection between the support post 80 and the base 10'.

The apparatus 100 of the present invention may be modified to include more additional bases 10' , each mounted by a plurality of support posts 80 to be disposed above an additional base 10' in the above described manner. A plurality of lower posts 20 and upper posts 50, not shown, extend upwardly from each of the additional bases 10'.

To use the apparatus 100 of the present invention, a plurality of outer race members **30*a* and 30*b* are mounted, as indicated above, to the uppermost ends of the plurality of lower posts 20 and upper posts 50. The apparatus 100, together with the plurality of outer race members 30*a* and 30*b* is heated in a carborizing atmosphere and subsequently quenched with a suitable cooling fluid, such as oil, to heat treat the plurality of outer race members 30*a* and 30*b*. During the heat treating operation, the passages 34 and 64 in the plurality of lower posts 20 and upper posts 50, respectively, communicate the cavities 28 of each of the outer race members 30*a* and 30*b* with the environment external to the cavity such as to vent carborizing atmosphere from the cavities. The passages 34 and 64 thereby permit admission of the cooling fluid into the cavity during the quenching operation. Furthermore, since the cavity 28** opens downwardly, the cooling fluid will not collect in the cavity so as to be removed from the quenching tank when the apparatus of the present invention is removed from the quenching tank.

The above detailed description is merely exemplary of the present invention. For example, while an array of twenty-five sockets is shown in the drawing, in practice, a much larger array of sockets, such as a 25×20 rectangular array, may be used. The number of sockets which are provided in the base 10 and the number of additional bases 10' will depend on the proportions of the ourter race member **30*a* and 30*b*, or other workpiece used in conjunction with the apparatus 100, on the proportions of the heat treatment apparatus, and the weight of the outer race member 30*a* or 30*b*** or other workpiece.

Still other variations and modifications may be made from the detailed description of the preferred embodiment without departing from the spirit of the present invention. Such modifications and variations are included within the intended scope of the claims appended hereto.

What is claimed as novel is as follows:

1. An apparatus for the heat treatment of an outer race member of a universal joint, said outer race member having a cavity formed therein, said apparatus comprising:

a horizontally disposed base means;

socket means integrally disposed with said horizontally disposed base means;

elongated vertically disposed post means, said elongated vertically disposed post means having a lower end interconnected with said horizontally disposed base means and an upper end remote from said lower end, said upper end removably insertable in said cavity of said outer race member such that said upper end supports said outer race member, said lower end of said elongated vertically disposed post means further comprising plug means, said plug means being removably insertable in said socket means for interconnecting said elongated vertically disposed post means with said horizontally disposed base means; and passage means extending at least partially longitudinally of said elongated vertically disposed post means, said passage means having a first port means opening into said cavity and a second port means disposed remote from said outer race member, said passage means communicating said cavity with the environment external of said cavity to vent fluid from said cavity during a heat treatment operation.

2. The apparatus of claim 1 further comprising a plurality of said elongated vertically disposed post means, each of said plurality of said elongated vertically disposed post means having lower and upper ends and passage means, each of said plurality of elongated vertically disposed post means extending upwardly from said horizontally disposed base means such that a plurality of said outer race members may be supported by said apparatus.

3. The apparatus of claim 2 wherein said plurality of said elongated vertically disposed post means are arranged in a horizontally staggered triangular array such as to provide clearance between adjacent outer race meabers of said plurality of said outer race members.

4. The apparatus of claim 2 wherein said plurality of said elongated vertically disposed post means further comprises:

a first plurality of post members having a first predetermined length such as to selectively support a first plurality of said outer race members at a first predetermined height; and a second plurality of post members having a second predetermined length such as to selectively support a second plurality of said outer race members at a second predetermined height, said second predetermined height being preselected to be sufficient to provide clearance between one of said first plurality of post members and one of said second plurality of post members disposed adjacent thereto.

5. The apparatus of claim 2 further comprising:

a plate disposed parallel to said horizontally disposed base means, and spaced a predetermined distance thereabove;

support means interconnecting said horizontally disposed base means and said plate; and an additional plurality of said elongated vertically disposed post means extending upwardly from said plate such that an additional plurality of said outer race members may be supported by said plate.

6. The apparatus of claim 5 wherein:

said horizontally disposed base means further comprises a first plurality of socket means;

said plate further comprises a second plurality of socket means;

said lower end of said plurality of elongated vertically disposed post means comprises first plug means for removably interconnecting each of said plurality of said elongated vertically disposed post means with said base means by insertion of each of said first plug means into one of said first plurality of socket means; and said upper end of each of said additional plurality of elongated vertically disposed post means comprises second plug means for interconnecting each of said additional plurality of elongated vertically disposed post means with said plate by insertion of each of said second plug means into one of said second plurality of socket means.

7. The apparatus of claim 6 wherein said first plurality of socket means form a first rectangular array and further wherein said second plurality of socket means form a second rectangular array.

8. The apparatus of claim 2 wherein:

said horizontally disposed base means further comprises a plurality of tube means, each of said plurality of tube means defining a vertically oriented socket, and a plurality of web means interconnecting said plurality of tube means; and said lower end of each of said plurality of elongated vertically disposed post means further comprises plug means, said plug means being removably insertable in at least one of said vertically oriented sockets for interconnecting said elongated vertically disposed post means with said horizontally disposed base means.

9. The apparatus of claim 8 further comprising:

a plate disposed parallel to said horizontally disposed base means and spaced a predetermined distance thereabove, said plate further comprising a plurality of tube means, each of said plurality of tube means defining a vertically oriented socket, and a plurality of web means interconnecting said plurality of tube means;

a plurality of support posts interconnecting said horizontally disposed base means and said plate, said plurality of support posts each having an upper plug removably insertable in each said vertically oriented socket of said plate and a lower plug removably insertable in each said vertically oriented socket of said horizontally disposed base means.

10. The apparatus of claim 1 wherein said elongated vertically disposed post means further comprises flange means extending upwardly of said upper end such as to separate said first port means of said passage means from said outer race member to facilitate communication of said cavity with said passage means.

11. The apparatus of claim 1 wherein said passage means further comprises:

a longitudinal bore in said elongated verically disposed post means, said longitudinal bore having an opening at the upper end thereof defining said first port means; and a transverse bore in said elongated vertically disposed post means, said transverse bore opening into a portion of said longitudinal bore remote from said first port means.

12. The apparatus of claim 11 further comprising a tube having a first end fitted into said transverse bore and a second end disposed remote from said first end, said second end of said tube defining said second port means.

13. The apparatus of claim 12 wherein said second end of said tube is disposed above said first end thereof.

14. The apparatus of claim 12 wherein said second end of said tube is disposed above said first port means.

15. The apparatus of claim 1 wherein said passage means comprises a U-shaped passage.

16. An apparatus for the heat treatment of a plurality of workpieces each having a cavity formed therein, said apparatus comprising:

horizontally disposed base means;

a plurality of sockets formed in said horizontally disposed base means;

a plurality of elongated vertically disposed post means, each of said plurality of elongated vertically disposed post means having a lower end and an upper end, said lower end having a plug removably insertable in one of said plurality of sockets of said horizontally disposed base means for interconnection of each of said plurality of elongated vertically disposed post means therewith, said upper end of each of said plurality of elongated vertically disposed post means being removably insertable in said cavity of one workpiece of said plurality of workpieces such that said upper end supports said one workpiece; and passage means extending at least partially longitudinally of each of said plurality of elongated vertically disposed post means, said passage means having a first port means opening into said cavity and a second port means disposed remote from said one workpiece, said passage means communicating said cavity with the environment external of said cavity to vent fluid from said cavity during a heat treatment operation.

17. The apparatus of claim 16 further comprising a plurality of said horizontally disposed base members, and a plurality of elongated support posts for interconnecting one of said plurality of horizontally disposed base means with another of said plurality of horizontally disposed base means, each of said plurality of support posts having a lower plug removably insertable in one socket of said plurality of sockets of said one of said plurality of horizontally disposed base means, and an upper plug disposed remote from said lower plug and removably insertable in another socket of said plurality of sockets of said other of said plurality of horizontally disposed base means.

18. The apparatus of claim 16 wherein said horizontally disposed base means further comprises a plurality of tube means, each of said plurality of tube means having a vertically disposed longitudinal axis, each of said plurality of tube means having a passage therethrough defining one of said plurality of sockets, said plurality of horizontally disposed base means further comprising a plurality of web means interconnecting said plurality of tube means.

19. A method for the heat treatment of an outer race member of a universal joint, said outer race member having a cavity formed therein, said method comprising the steps of:

mounting a removably insertable plug means disposed in a lower end of an elongated vertically disposed post to a base having a socket adapted to receive said removably insertable plug means;

mounting said outer race member to an upper end of said elongated vertically disposed post by inserting said upper end of said elongated vertically disposed post into said cavity of said outer race member;

heating said outer race member to a predetermined temperature level in a carborizing atmosphere;

communicating said carborizing atmosphere captured in said cavity of said outer race member with the environment external to said outer race member by the use of passage means formed in said elongated vertically disposed post;

venting said carborizing atmosphere captured in said cavity of said outer race member by communicating said cavity with the environment external to said outer race member by the use of tube means located between said cavity and said passage means and communicating said tube means with said passage means formed in said elongated vertically disposed post such that said cavity is vented; and quenching said outer race member by submerging said outer race member in a cooling fluid to rapidly cool said outer race member.

* * * * *

UNITED STATES PATENT AND TRADEMARK OFFICE

CERTIFICATE OF CORRECTION

PATENT NO. : 4,572,749

DATED : February 25, 1986

INVENTOR(S) : Richard Emerson

It is certified that error appears in the above-identified patent and that said Letters Patent is hereby corrected as shown below:

Column 2, line 1, delete "meabers" and insert ---- members ----.

Column 3, line 39, delete "$S_{1,1}$", second occurrence, and insert ---- $S_{5,5}$ ----.

Signed and Sealed this

First Day of July 1986

[SEAL]

Attest:

DONALD J. QUIGG

Attesting Officer

Commissioner of Patents and Trademarks